US012458851B2

(12) United States Patent
Ozaki et al.

(10) Patent No.: US 12,458,851 B2
(45) Date of Patent: Nov. 4, 2025

(54) GOLF CLUB HEAD AND METHOD FOR MANUFACTURING THE SAME

(71) Applicant: Sumitomo Rubber Industries, Ltd., Kobe (JP)

(72) Inventors: Yohei Ozaki, Kobe (JP); Seiji Hayase, Kobe (JP); Masahide Onuki, Kobe (JP)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 11 days.

(21) Appl. No.: 18/114,391

(22) Filed: Feb. 27, 2023

(65) Prior Publication Data

US 2023/0277904 A1 Sep. 7, 2023

(30) Foreign Application Priority Data

Mar. 4, 2022 (JP) ..... 2022-033819

(51) Int. Cl.
*A63B 53/04* (2015.01)
*A63B 53/06* (2015.01)
*A63B 53/08* (2015.01)

(52) U.S. Cl.
CPC ..... *A63B 53/06* (2013.01); *A63B 53/0408* (2020.08); *A63B 53/0433* (2020.08); *A63B 53/0437* (2020.08); *A63B 53/0466* (2013.01); *A63B 53/08* (2013.01)

(58) Field of Classification Search
CPC ..... A63B 53/0433; A63B 53/0437
See application file for complete search history.

(56) References Cited

U.S. PATENT DOCUMENTS 4,809,982 A * 3/1989 Kobayashi ..... A63B 53/04 473/327
6,080,070 A * 6/2000 Whitley ..... A63B 60/52 473/328
6,955,612 B2 * 10/2005 Lu ..... A63B 53/0466 473/409
7,074,136 B2 * 7/2006 Noguchi ..... A63B 60/52 473/346
7,108,614 B2 * 9/2006 Lo ..... A63B 60/52 473/345
7,252,599 B2 * 8/2007 Hasegawa ..... A63B 53/0466 473/347
7,582,024 B2 * 9/2009 Shear ..... A63B 60/52 473/332

(Continued)

FOREIGN PATENT DOCUMENTS

JP 2009011839 A * 1/2009 ..... A63B 53/04
JP 2017159062 A * 9/2017 ..... A63B 53/04

(Continued)

*Primary Examiner* — Alvin A Hunter
(74) *Attorney, Agent, or Firm* — Birch, Stewart, Kolasch & Birch, LLP

(57) ABSTRACT

A golf club head having a hollow portion therein, the head includes a face portion, and a main body including a crown portion and a sole portion each extending backwardly from the face portion. The main body is provided with at least one slit that penetrates the main body and extends in a head-front-back direction. The at least one slit includes a pair of slit inner walls extending in the head-front-back direction and at least one joint connecting the pair of slit inner walls to each other.

16 Claims, 14 Drawing Sheets

(56) References Cited

U.S. PATENT DOCUMENTS

| | | | | |
|---|---|---|---|---|
| 7,892,111 | B2 * | 2/2011 | Morales | A63B 53/0466 473/348 |
| 8,435,134 | B2 * | 5/2013 | Tang | A63B 53/0466 473/332 |
| 8,608,587 | B2 * | 12/2013 | Henrikson | A63B 60/52 473/409 |
| 8,821,312 | B2 * | 9/2014 | Burnett | A63B 53/0475 473/345 |
| 8,827,831 | B2 * | 9/2014 | Burnett | A63B 60/50 473/332 |
| 8,827,835 | B1 * | 9/2014 | Griffin | A63B 60/54 473/332 |
| 8,961,335 | B2 * | 2/2015 | Sugimoto | A63B 53/0466 473/332 |
| 9,079,079 | B2 * | 7/2015 | Fossum | A63B 60/52 |
| 9,089,749 | B2 * | 7/2015 | Burnett | A63B 53/0466 |
| 9,320,948 | B2 * | 4/2016 | Fossum | A63B 60/00 |
| 9,950,220 | B2 * | 4/2018 | Larson | A63B 60/50 |
| 10,150,016 | B2 * | 12/2018 | Willett | A63B 53/06 |
| 10,874,916 | B2 * | 12/2020 | Willett | A63B 53/0466 |
| 11,179,608 | B2 * | 11/2021 | Greaney | A63B 60/00 |

FOREIGN PATENT DOCUMENTS

| | | | | | |
|---|---|---|---|---|---|
| JP | 2017196247 | A | * | 11/2017 | A63B 53/0408 |
| JP | 2018093938 | A | * | 6/2018 | A63B 53/04 |
| JP | 2018175519 | A | * | 11/2018 | A63B 53/0437 |
| JP | 2019072501 | A | * | 5/2019 | A63B 53/04 |
| JP | 2019146938 | A | * | 9/2019 | A63B 53/0425 |
| JP | 2019-181007 | A | | 10/2019 | |

* cited by examiner

FIG.15A

| | | Toe | | | | | | | | | | Heel |
|---|---|---|---|---|---|---|---|---|---|---|---|---|
| | | -25 | -20 | -15 | -10 | -5 | 0 | 5 | 10 | 15 | 20 | 25 |
| Up | 15 | 187 | | | | | | | | | | 181 |
| | 10 | | | 225 | | | 220 | | | 229 | | |
| | 5 | | | | | | | | | | | |
| | 0 | | | 226 | | | 234 | | | 226 | | |
| | -5 | | | | | | | | | | | |
| Down | -10 | | | 194 | | | 201 | | | 189 | | |
| | -15 | 140 | | | | | 174 | | | | | 134 |

FIG.15B

| | | Toe | | | | | | | | | | Heel |
|---|---|---|---|---|---|---|---|---|---|---|---|---|
| | | -25 | -20 | -15 | -10 | -5 | 0 | 5 | 10 | 15 | 20 | 25 |
| Up | 15 | 188 | | | | | | | | | | 182 |
| | 10 | | | 230 | | | 226 | | | 231 | | |
| | 5 | | | | | | | | | | | |
| | 0 | | | 232 | | | 239 | | | 232 | | |
| | -5 | | | | | | | | | | | |
| Down | -10 | | | 202 | | | 210 | | | 194 | | |
| | -15 | 140 | | | | | 186 | | | | | 136 |

FIG.15C

| | | Toe | | | | | | | | | | Heel |
|---|---|---|---|---|---|---|---|---|---|---|---|---|
| | | 25 | 20 | 15 | 10 | 5 | 0 | -5 | -10 | -15 | -20 | -25 |
| Up | 15 | 1 | | | | | | | | | | 1 |
| | 10 | | | 5 | | | 6 | | | 1 | | |
| | 5 | | | | | | | | | | | |
| | 0 | | | 6 | | | 5 | | | 6 | | |
| | -5 | | | | | | | | | | | |
| Down | -10 | | | 8 | | | 9 | | | 4 | | |
| | -15 | 6 | | | | | 12 | | | | | 2 |

| | | Toe | | | | | | | | | | Heel |
|---|---|---|---|---|---|---|---|---|---|---|---|---|
| | | 25 | 20 | 15 | 10 | 5 | 0 | -5 | -10 | -15 | -20 | -25 |
| Up | 15 | 2 | | | | | | | | | | 0 |
| | 10 | | | 1 | | | 4 | | | 0 | | |
| | 5 | | | | | | | | | | | |
| | 0 | | | 3 | | | 2 | | | 1 | | |
| | -5 | | | | | | | | | | | |
| Down | -10 | | | 7 | | | 4 | | | -1 | | |
| | -15 | 13 | | | | | 2 | | | | | 1 |

s1 cross-section

GOLF CLUB HEAD AND METHOD FOR MANUFACTURING THE SAME

RELATED APPLICATIONS

This application claims the benefit of foreign priority to Japanese Patent Application No. JP2022-033819, filed Mar. 4, 2022, which is incorporated by reference in its entirety.

FIELD OF THE DISCLOSURE

The present disclosure relates to a golf club head having a hollow portion therein and a method for manufacturing the same.

BACKGROUND OF THE DISCLOSURE

According to the Rules of Golf set forth by the United States Golf Association (USGA), golf club heads must not have a spring-like effect that exceeds the upper limit set forth in the Pendulum Test Protocol. Specifically, the CT (Characteristic Time) value of golf club heads is regulated to be less than a specified value. As a technology for controlling the CT value, the following patent document 1 has been proposed.

PATENT DOCUMENT 1

Japanese Unexamined Patent Application Publication No. 2019-181007

SUMMARY OF THE DISCLOSURE

Various manufacturing errors may occur during the process of mass production of golf club heads. In consideration of such manufacturing errors, golf club manufacturers produce golf club heads with a CT value much lower than the upper limit of the Rules of Golf, and then adjust the CT so that it is below the upper limit of the Rules of Golf and close to the upper limit. For example, this adjustment includes a process of grinding the striking faces of golf club heads.

However, the shape of the striking face of golf club heads has a great influence on the trajectory of hit balls, such as the launch angle and the amount of spin. Therefore, the conventional process of adjusting the CT may cause changes in the trajectory of hit balls.

The present disclosure has been made in view of the above circumstances and has a main object to provide a golf club head capable of adjusting the rebound performance while suppressing changes in the trajectory of hit balls, and a manufacturing method thereof.

In one aspect of the present disclosure, a golf club head with a hollow portion therein, the head includes a face portion, and a main body including a crown portion and a sole portion each extending backwardly from the face portion. The main body is provided with at least one slit that penetrates the main body and extends in a head-front-back direction. The at least one slit includes a pair of slit inner walls extending in the head-front-back direction and at least one joint connecting the pair of slit inner walls to each other.

BRIEF DESCRIPTION OF THE DRAWINGS

FIG. 15A is a graph showing a distribution of CT values of the first golf club head, FIG. 15B is a graph showing a distribution of CT values of the second golf club head, and FIG. 15C is a graph showing the CT value difference between them;

DETAILED DESCRIPTION OF THE DISCLOSURE

Figure 1:
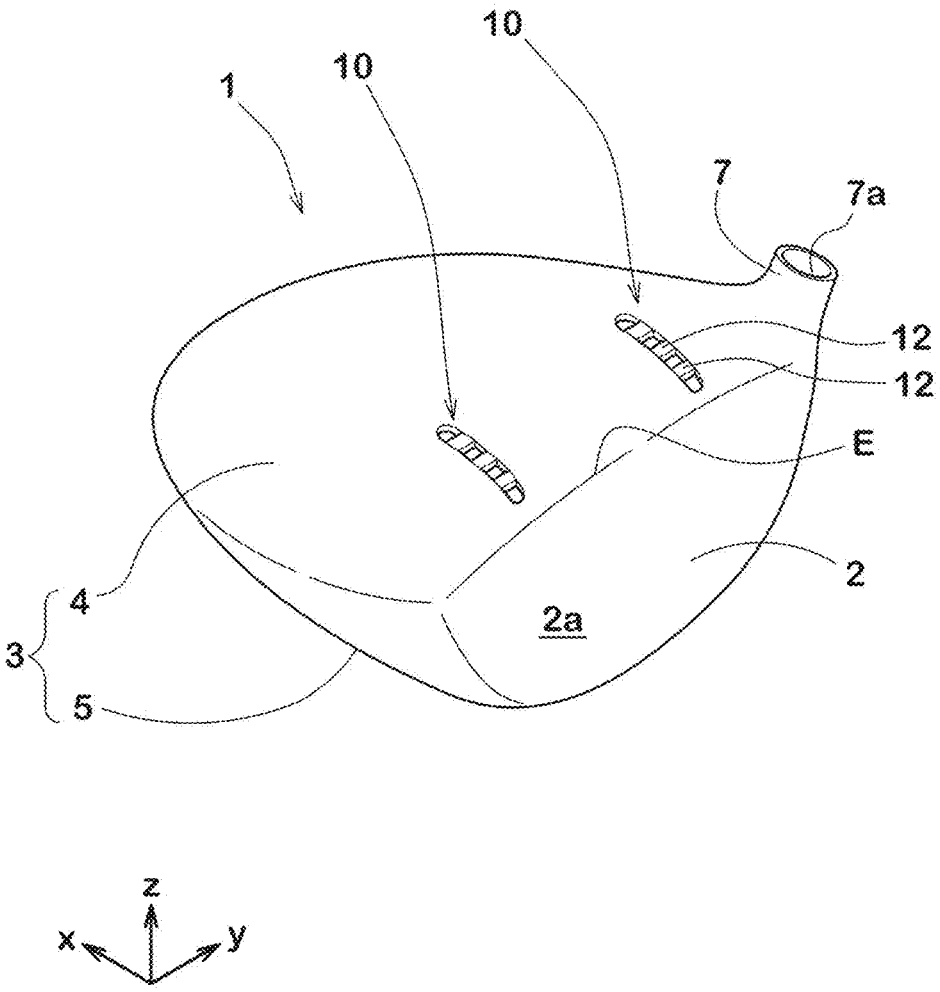
FIG. 1 is a perspective view of a golf club head according to the first embodiment.

Hereinafter, one or more embodiments of the present disclosure will be described below based on the drawings.

Throughout the embodiments, the same elements and portions are denoted by the same reference characters, and duplicate explanations are omitted.

First Embodiment

FIGS. 1 to 4 respectively show a perspective view, a front view, a plan view, and a bottom view of a golf club head (hereinafter, simply referred to as "head") 1 according to the first embodiment.

[Reference State, Etc.]

Figure 2:
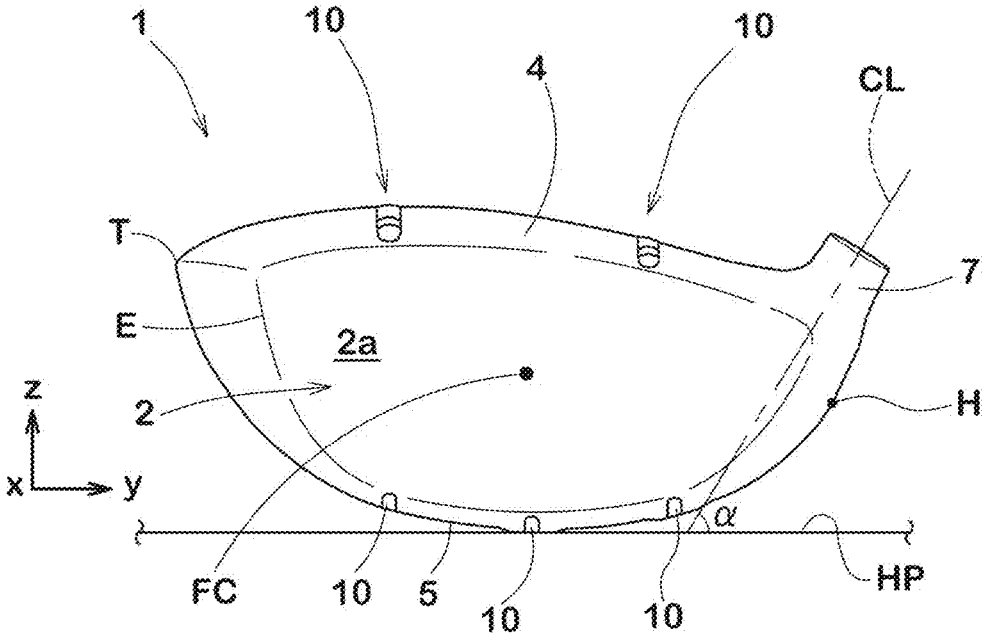
FIG. 2 is a front view of the golf club head according to the first embodiment.
Figure 3:
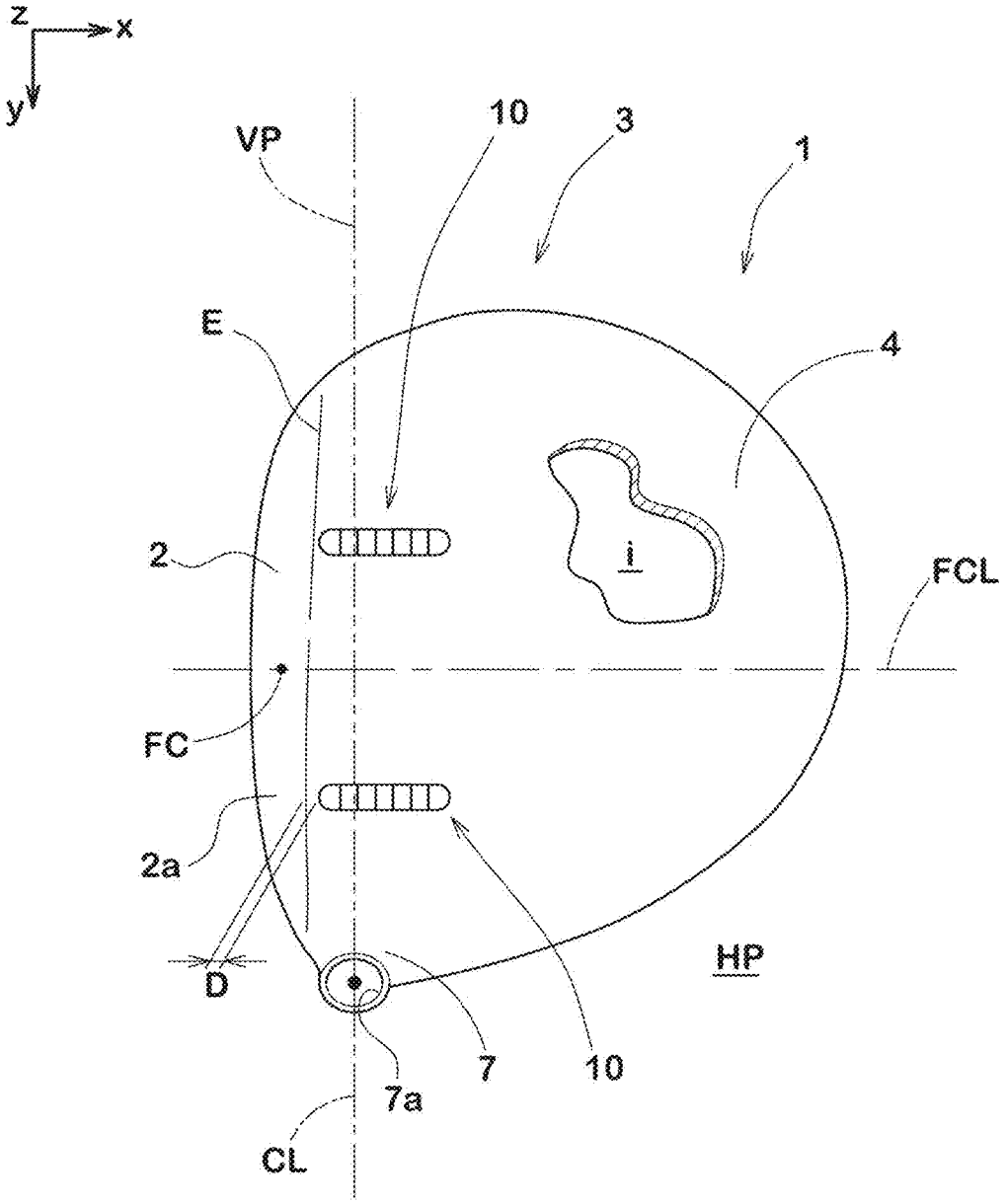
FIG. 3 is a plan view of the golf club head according to the first embodiment.

In FIGS. 1 to 4, the head 1 is in a reference state. The reference state is the state that the head 1 is placed on a horizontal plane HP with the lie angle $\alpha$ (FIG. 2) and the loft angle (not illustrated) defined for the head 1. In the reference state, the shaft centerline CL of the head 1 is located in the reference vertical plane VP (FIG. 3). The shaft centerline CL is defined by the axis centerline of a shaft insertion hole 7*a* formed in the hosel portion 7 of the head 1. Unless otherwise mentioned herein, the head 1 shall be placed in the reference state.

[Head Coordinate System]

As used herein, an x-y-z coordinate system is associated with the head 1. The x-axis is defined as the axis orthogonal to the reference vertical plane VP and parallel to the horizontal plane HP. The y-axis is parallel to both the reference vertical plane VP and the horizontal plane HP. The z-axis is defined as the axis orthogonal to both the x-axis and y-axis. For the head 1, the direction along the x-axis is defined as the head-front-back direction, the direction along the y-axis as the toe-heel direction, and the direction along the z-axis as the head-up-down direction. The side of the face portion 2 is the front side and the opposite side is the back side with respect to the head-front-back direction.

[Head Basic Structure]

The head 1 is essentially made of metal material and has a hollow portion (i) therein, as shown in FIG. 3. The hollow portion (i), for example, may be left as it is, or a gel agent for weight adjustment may be placed in a part of it.

As metal materials for the head 1, stainless steel, maraging steel, titanium, titanium alloys, magnesium alloys, aluminum alloys, etc. are suitable, for example. Fiber-reinforced resin may be used as a part of the head 1.

As illustrated in FIGS. 1 to 4, the head 1 is, for example, a wood type. The head 1 of the wood type includes, for example, at least a driver, a fairway wood, a hybrid, and the like. The head 1 in this embodiment is configured as a driver.

The head 1 includes the face portion 2 and a main body 3 extending backwardly from the face portion 2. The main body 3, for example, includes a crown portion 4, a sole portion 5 and the hosel portion 7, at least. In FIG. 2, the reference character "T" indicates the toe of the head 1 and the reference character "H" indicates the heel of the head 1.

The face portion 2 is the portion that strikes a ball and is formed on the front side of the head 1. The face portion 2 includes a striking face 2*a* that is in direct contact with the ball. The face portion 2 has a relatively large wall thickness to prevent damage during ball striking. In some preferred aspects, the face portion 2 has a greater thickness than those of the crown portion 4, the sole portion 5, and the like. The thickness of the face portion 2 is not particularly limited, but is, for example, equal to or more than 2.0 mm, preferably equal to or more than 2.2 mm. On the other hand, in order to allow the face portion 2 to flex sufficiently when striking the ball, the thickness of the face portion 2 is, for example, equal to or less than 4.0 mm, preferably equal to or less than 3.8 mm.

Figure 18A:
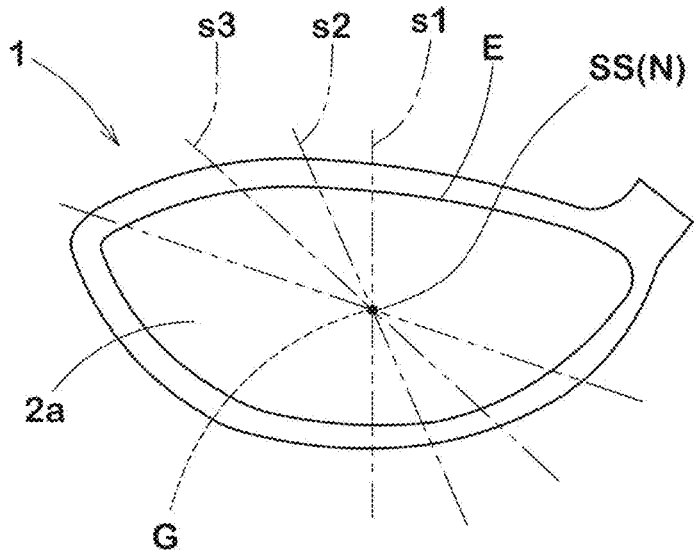
FIG. 18A is a front view of the golf club head.
Figure 18B:
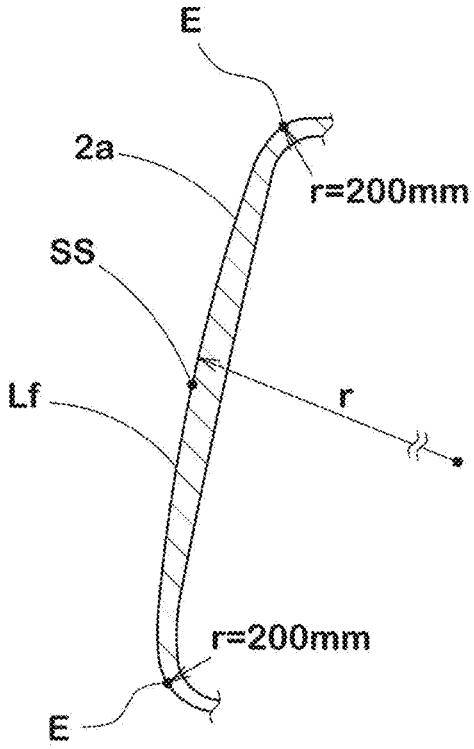
FIG. 18B is a cross-sectional view taken along line s1 of the golf club head.

The face portion 2 includes a periphery E defining the boundary of the striking face 2*a*. As used herein, the periphery E of the face portion 2 is the ridge line if it is visible to the naked eye as a clear ridge line. On the other hand, if such a ridge line is not clearly formed, the periphery E of the face portion 2 is obtained as follows. First, as illustrated in FIG. 18A, cross sections s1, s2, s3 . . . , including the normal N passing the center of gravity G of the head and the sweet spot SS are specified. Next, as illustrated in FIG. 18B, in each of the cross sections s1, s2, s3 . . . , the positions E where the radius of curvature r of the contour line Lf of the striking face 2*a* becomes 200 mm for the first time from the sweet spot SS side toward outwardly of the face portion are specified, and a series of these positions E in the cross sections is defined as the periphery E of the face portion 2.

The crown portion 4 extends from the periphery E of the face portion 2 backwardly of the head so as to form an upper surface of the head. The hosel portion 7 is provided on the heel side of the crown portion 4. The hosel portion 7 has the shaft insertion hole 7*a* for fixing a shaft (not illustrated). The crown portion 4 is the portion excluding the face portion 2 and the hosel portion 7 in a plan view of the head shown in FIG. 3.

Figure 4:
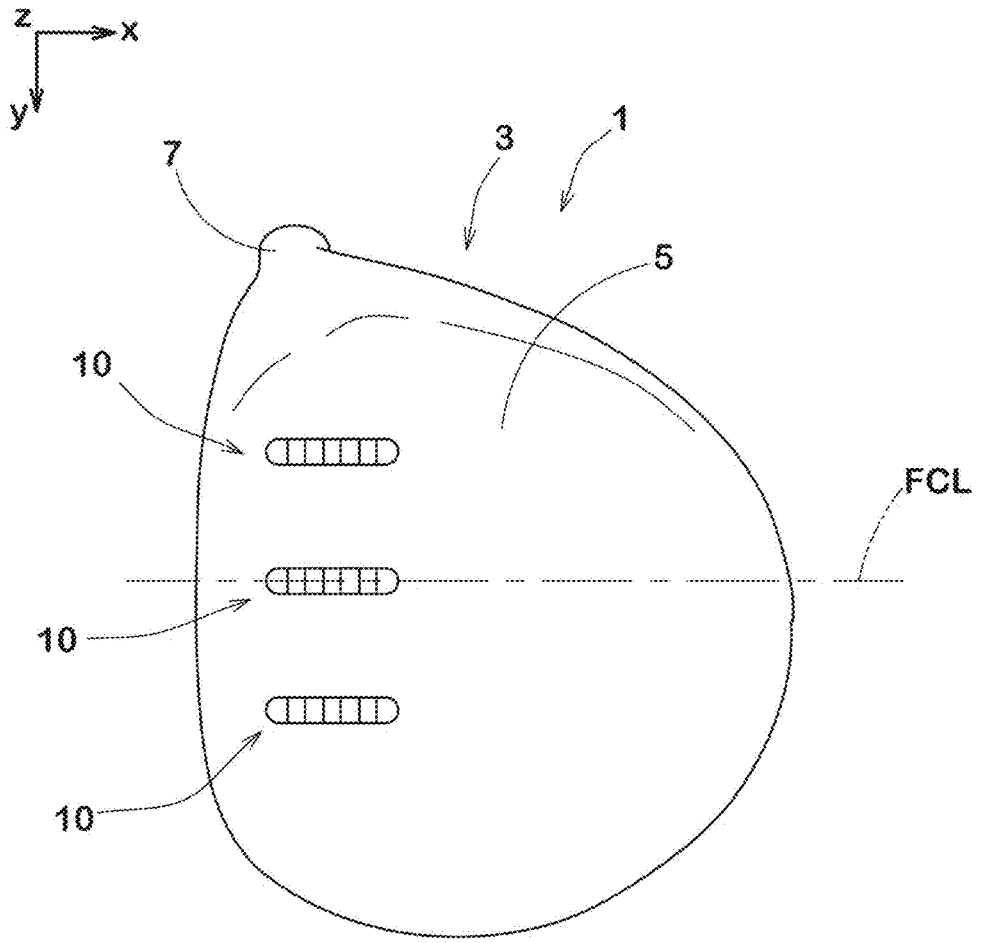
FIG. 4 is a bottom view of the golf club head according to the first embodiment.

As illustrated in FIG. 1 and FIG. 4, the sole portion 5 extends from the periphery E of the face portion 2 backwardly of the head so as to form a bottom surface of the head. The sole portion 5 is the portion excluding the hosel portion 7 in a bottom view of the head.

[Slit(s)]

The main body 3 is provided with at least one slit 10 that penetrates the main body 3. In some preferred embodiments, at least one of the crown portion 4 and the sole portion 5 is provided with a plurality of slits 10. The plurality of slits 10 is spaced in the toe-heel direction of the head. In the example of FIGS. 1 to 4, each of the portions crown portion 4 and the sole portion 5 is provided with a plurality of slits 10 that is spaced in the toe-heel direction of the head.

Specifically, the crown portion 4 has two slits 10, which are located on the toe and heel sides with respect to the head-front-back direction line FCL of the head passing through the face center FC. In addition, the sole portion 5 has three slits 10, which are distributed on the toe side and heel side of the head-front-back direction line FCL and on the head-front-back direction line FCL. The face center FC is the position of each center in the toe-heel direction and the head-up-down direction of the striking face 2*a*. Alternatively, one or more slits 10 may be provided only in the crown portion 4 or only in the face portion 2. Further, only one slit 10 may be provided in the crown portion 4, or may be provided in the sole portion 5.

Figure 5:
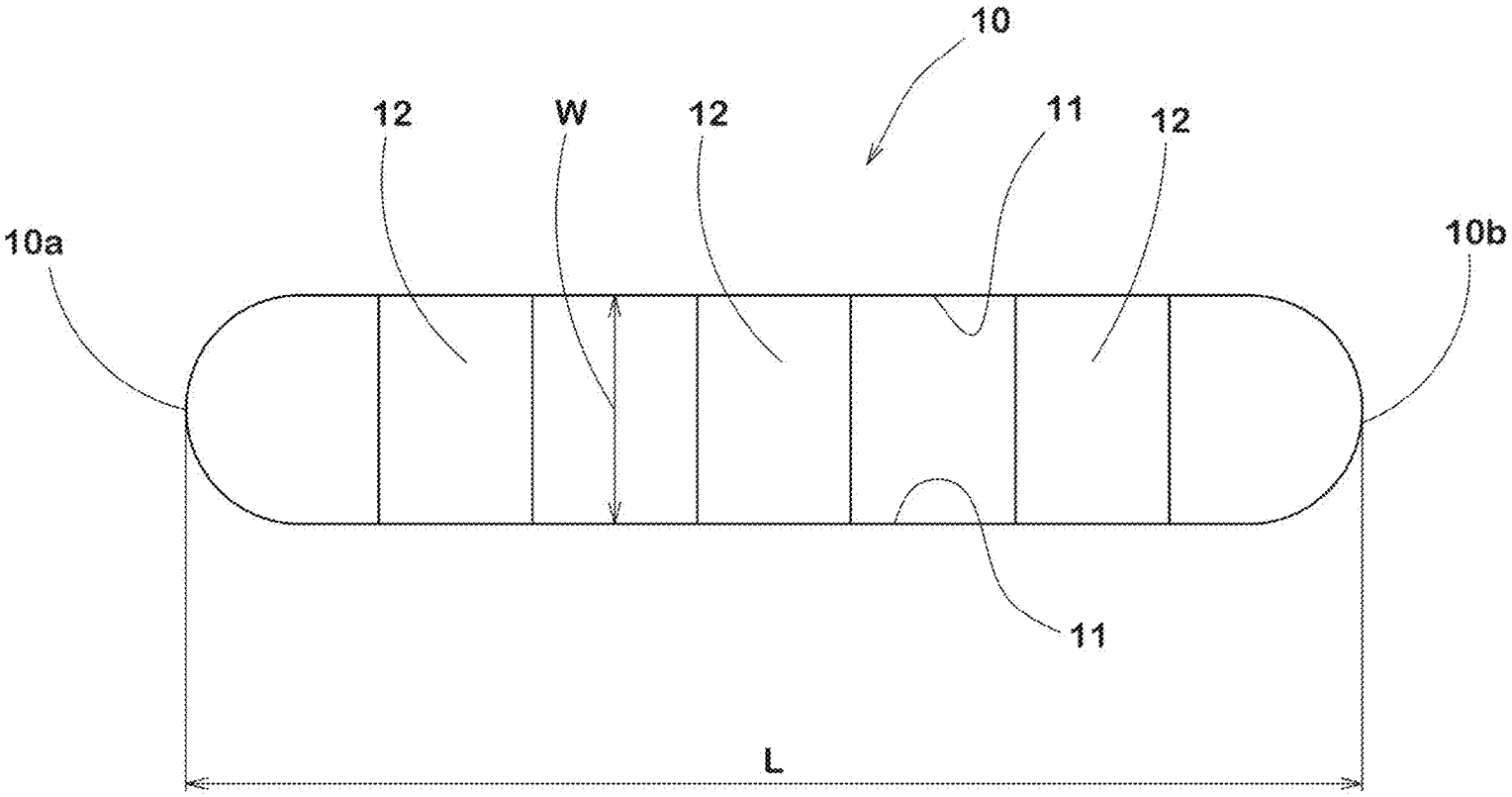
FIG. 5 is a plan view of a slit.
Figure 6:
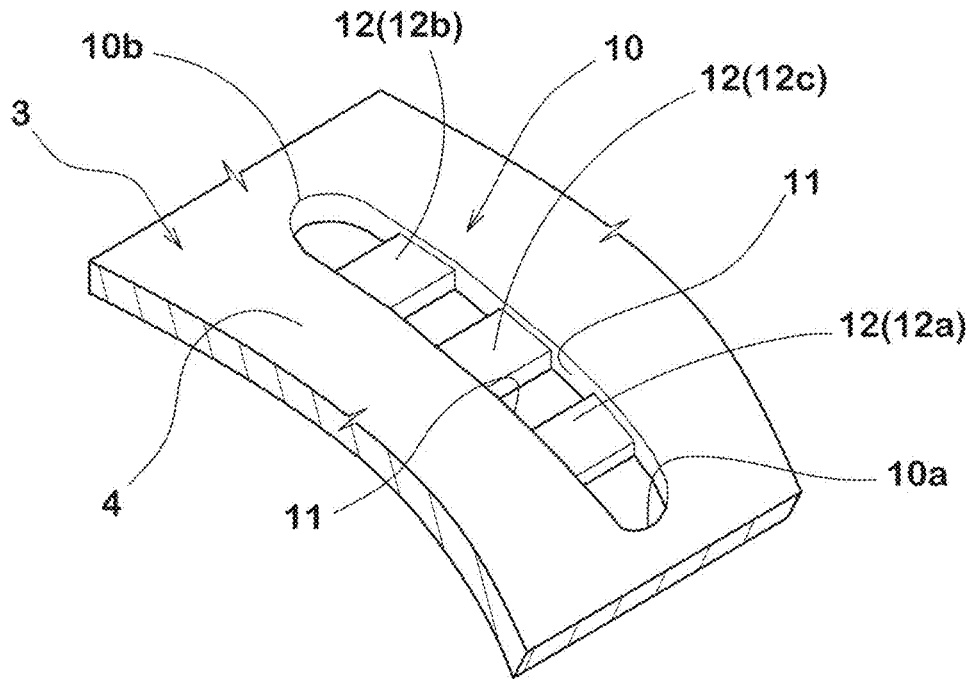
FIG. 6 is a perspective view of the slit.

FIG. 5 illustrates an enlarged plan view of one slit 10, and FIG. 6 is a perspective view of the slit 10. As illustrated in FIG. 5 and FIG. 6, each slit 10 has a frontmost end 10*a*, a backmost end 10*b*, a pair of slit inner walls 11, a Length L in the head-front-back direction, and a width W in the toe-heel direction of the head. The length L of slit 10 is sufficiently larger than the width W of the slit 10. Thus, the slit 10 is elongated in the head-front-back direction. In this example, the slit 10 extends straight in the longitudinal direction. That is, the pair of slit inner walls 11 extends straight along the head-front-back direction.

When the ball is struck with the striking face 2*a* of the face portion 2, the crown portion 4 and the sole portion 5, which are connected to the face portion 2, are subjected to tensile deformation in the toe-heel direction in addition to bending deformation in the head-front-back direction. On the other hand, one or more slits 10 can locally reduce the tensile stiffness of the main body 3 (e.g., the crown portion 4 and/or the sole portion 5) in the toe-heel direction. Thus, the main body 3 with one or more slits 10 can flex (stretch) more in the toe-heel directions, starting from the slits 10, and can contribute to the flexion of the face portion 2. This has the advantage of expanding the highly resilient area of the face portion 2 in the direction of the area provided with the slits.

In order to effectively promote the deflection in the toe-heel direction of the main body 3 as described above, the length L of the slits 10 is, for example, equal to or more than 10 mm, preferably equal to or more than 12 mm, more preferably equal to or more than 15 mm. On the other hand, if the length L of the slits 10 is excessively large, the durability of the main body 3 may decrease. From this point of view, the length L of the slits 10 is, for example, equal to or less than 40 mm, preferably equal to or less than 30 mm, more preferably equal to or less than 25 mm.

In order to effectively promote the deflection in the toe-heel direction of the main body 3, the width W of the slits 10 is, for example, equal to or more than 0.5 mm, preferably equal to or more than 1 mm, more preferably equal to or more than 2 mm. On the other hand, a larger width W of the slits 10 may decrease the durability of the main body 3. From this point of view, the width W of slits 10 is, for example, equal to or less than 10 mm, preferably equal to or less than 8 mm, more preferably equal to or less than 6 mm. The width W of the slits 10 can be constant or variable.

In order to effectively promote the deflection in the toe-heel direction of the main body 3, the slits 10 are preferably placed closer to the face portion 2. As illustrated in FIG. 3, the minimum distance D between the frontmost end 10*a* of each slit 10 (shown in FIG. 5) and the periphery E of the face portion 2 is, for example, equal to or less than 10 mm, preferably equal to or less than 3 mm, more preferably equal to or less than 1 mm. Further, the periphery E of the face portion 2 is a corner where the face portion 2 and the main body 3 are connected, and the rigidity around the periphery E tends to be high, resulting in relatively small deformation when the ball is struck. Thus, there is an advantage that the increase of stress near the frontmost end 10*a* of each slit 10 is effectively suppressed by making the frontmost end 10*a* of each slit 10 closer to the periphery E.

[Joint(s)]

As illustrated in FIG. 5 and FIG. 6, at least one slit 10 includes at least one joint 12 connecting the pair of slit inner walls 11 to each other. In this embodiment, the slit 10 is provided with a plurality of joints 12. The plurality of joints 12 is spaced in the head-front-back direction. As illustrated in FIG. 6, the plurality of joints 12 includes a front joint 12*a* spaced apart from the frontmost end 10*a* of the slit 10 in the head-front-back direction, a back joint 12*b* spaced apart from the backmost end 10*b* of the slit 10 in the head-front-back direction, and at least one intermediate joint 12*c* spaced from the front joint 12*a* and the back joint 12*b* in the head-front-back direction.

The joints 12 according to the present embodiment can be used as an adjusting member to adjust the tensile stiffness of the main body 3 in the toe-heel direction of the head. For example, after the head 1 has been manufactured, at least one joint 12 of at least one slit 10 may be at least partially removed, if necessary. The slit 10, from which the joint 12 has been removed partially, can reduce the tensile stiffness of the main body 3 in the toe-heel direction without substantially changing the bending stiffness of the main body 3 in the head-front-back direction, compared to other slits 10 where the joint 12 has not been removed. Such a slit 10 can help to provide a greater deflection (elongation) of the main body 3 in the toe-heel directions when striking the ball, and can increase the rebound performance, i.e., the CT, at the striking position corresponding to the slit 10. Although the tensile stiffness in the toe-heel direction of the main body 3 changes with the presence or absence of the joints 12 and the number of joints 12, the change in the bending stiffness in the front-back direction of the head can be very small. The present disclosure takes note of this point and changes the tensile stiffness in the toe-heel direction with little change in the bending stiffness of the main body 3 in the head-front-back direction, depending on the presence or absence and the number of joints 12. This makes it possible to adjust the rebound performance without changing the spin and launch angle of hit balls. The change (decrease) in the bending stiffness of the main body 3 in the head-front-back direction may change the orientation of the striking face 2*a* (increasing the rotation) when a ball is struck, changing the spin and launch angle of hit balls. Therefore, such changes are undesirable.

For example, in the crown portion 4 and/or the sole portion 5, if one or more joints 12 of the slit 10 on the toe side are removed, the CT of the toe side of the striking face 2*a* can be increased. Further, in the crown portion 4 and/or the sole portion 5, if one or more joints 12 of the slit 10 on the heel side are removed, the CT of the heel side of the striking face 2*a* can be increased. Furthermore, in the sole portion 5, if one or more joints 12 of the slit 10 in the center are removed, the CT near the face center FC can be increased. Therefore, it is possible to adjust the CT of the head 1 without grinding the face portion 2.

Figure 7:
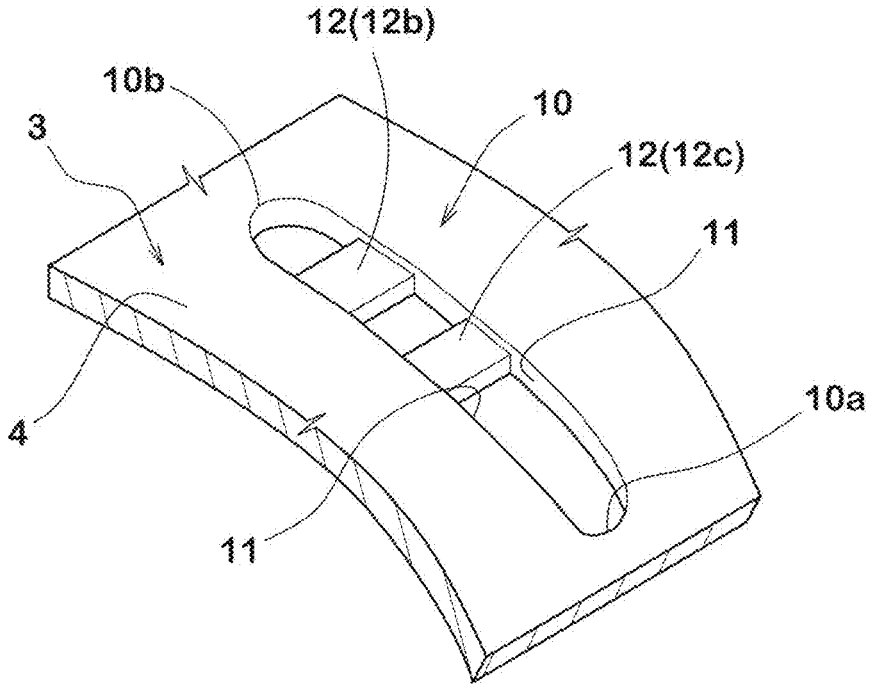
FIG. 7 is a perspective view of the slit with one joint removed.

FIG. 7 is a perspective view of FIG. 6 showing an example where one joint member 12 has been completely removed from the slit 10. In FIG. 7, the front joint 12*a* has been removed. This can result in new slit inner walls 11 in the area where the front joint 12*a* was present. Alternatively, the joint 12 may be partially removed so that the connection between the slit inner walls 11 and 11 is broken. For example, only the middle part of one joint 12 in the toe-heel direction may be removed. Even in this manner, the tensile stiffness in the toe-heel direction of the head around the slit 10 of the main body 3 can be reduced.

When a plurality of joints 12 is provided in each slit 10, one or more joints 12 may be removed. When a plurality of joints 12 is provided in the head-front-back direction, the margin of improvement of CT can be adjusted arbitrarily by changing the number of joints 12 to be removed.

The shape of the joint 12 is not particularly limited. For example, the joints 12 may have a cylindrical or prismatic shape extending in the toe-heel direction of the head. In the embodiment of FIG. 6, each joint 12 has a slightly smaller thickness than the main body 3 (the crown portion 4). The outer surface of each joint 12 may be recessed like a step from the outer surface of the main body 3, as shown in FIG. 6. In such an embodiment, a joint removal process is more efficient because the position of the joints 12 can be easily determined.

In this embodiment, the joints 12 extends in the toe-heel direction with a constant cross-sectional area. In another embodiment, the joints 12 may be formed with the same wall thickness as the main body 3. The joints 12 may also be varied such that their cross-sectional area is locally increased or decreased. Furthermore, the joints 12 and the slit inner walls 11 may be connected by a smooth circular arc surface (not illustrated) in order to reduce stress concentration thereon.

In order to effectively achieve the adjusting effect of the rebound performance, in a plan view of each slit 10*a*, a total joint projected area is preferably equal to or less than 0.8 times the total projected area of the slit 10 including the joints 12. In the embodiment of FIG. 6, the total joint projected area is the sum of the projected areas of the front, back, and middle joints 12*a*, 12*b*, and 12*c*. The total projected area of the slit 10 including the joints 12 is the total area enclosed by the contour line of the slit 10 in FIG. 5 and FIG. 6.

[Another Example of Slit(s)]

Figure 8:
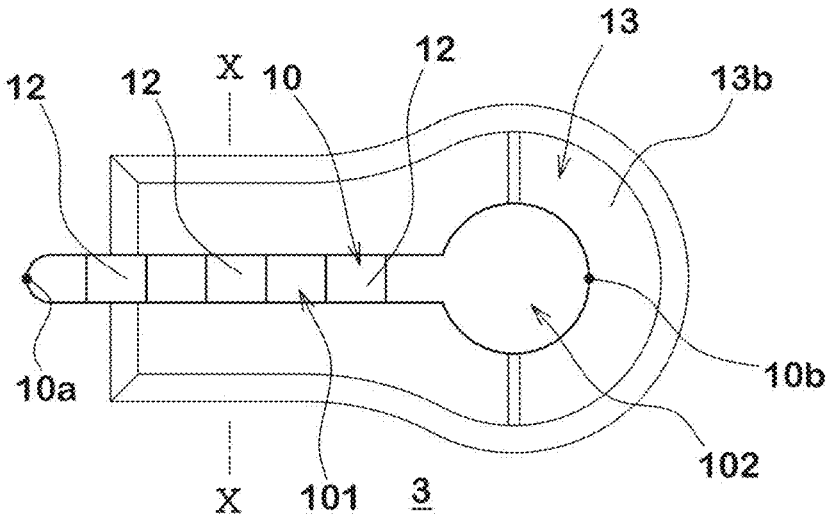
FIG. 8 is a plan view of another example of the slit, viewed from the outer side of the head.
Figure 9:
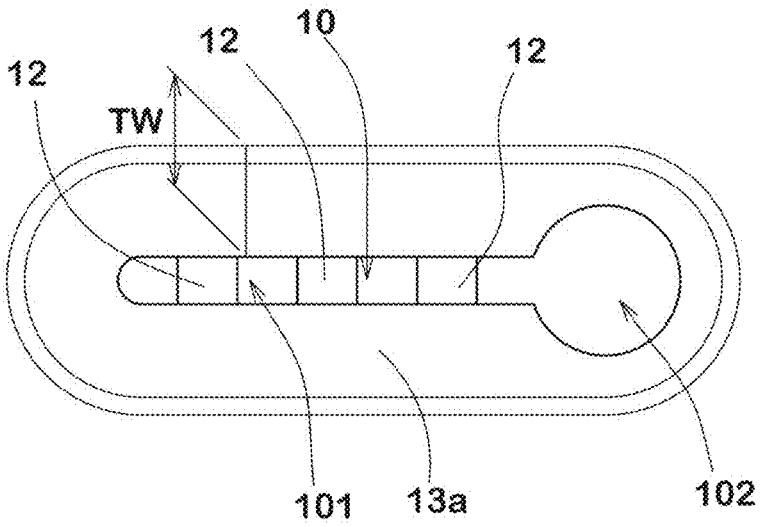
FIG. 9 is a plan view of the example of the slit viewed from the inside of the head.
Figure 10:
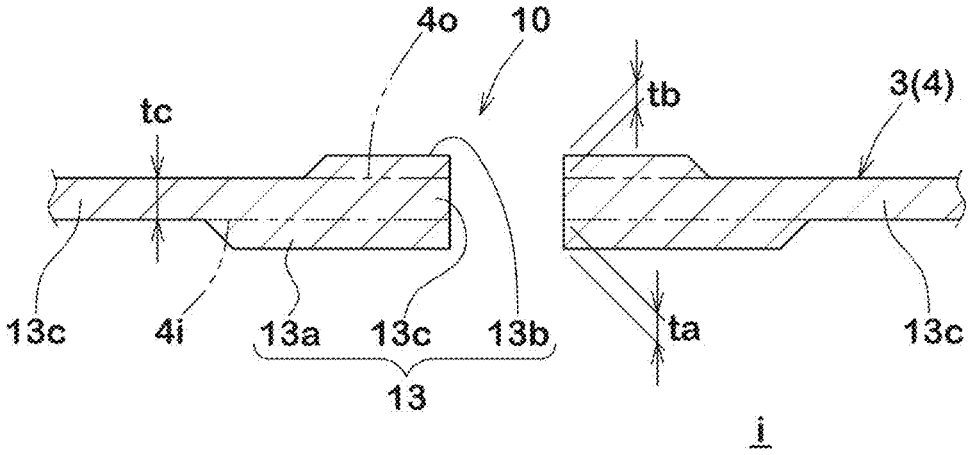
FIG. 10 is a cross-sectional view taken along the lines X-X of FIG. 8.

FIG. 8 is a plan view of another example of the slit 10 viewed from the outer side of the head, and FIG. 9 is a plan view of the slit 10 viewed from the inside of the head. FIG. 10 is a cross-sectional view taken along the lines X-X of FIG. 8. As shown in FIGS. 8 to 10, the slit 10 includes a first portion 101 extending backwardly of the head from the frontmost end 10*a*, and a second portion 102 connected to the first portion 101 and having a circular outline.

In the example, the first portion 101 extends with a constant width. A plurality of joints 12 is formed in the first portion 101.

The width of the second portion 102 is larger than that of the first portion 101. Such a slit 10 can help to effectively suppress the stress increase near the backmost end 10*b* of the slit 10, where the deformation of the main body 3 is likely to increase. In some preferred embodiments, the width of the second portion 102 is equal to or more than 1.5 times the width of the first portion 101, more preferably equal to or more than 2.0 times.

Around the slit 10, a thick-walled portion 13 is formed by locally increasing the thickness of the main body 3. When the ball is struck, the area around the slit 10 of the main body 3 is subject to high stress due to the bending stress caused by bending in the head-front-back direction and the tensile stress caused by tensile deformation in the toe-heel direction. Strictly speaking, the slit 10 also slightly reduces the bending rigidity in the head-front-back direction. However, when the thick-walled portion 13 is formed as described above, the decrease in bending rigidity in the head-front-back direction can be suppressed while the tensile rigidity in the toe-heel direction is locally decreased. In addition, the slit 10 with the thick-walled portion 13 can disperse the stress in the periphery of the slit 10 and suppress the local increase in stress.

The thick-walled portion 13 is provided, for example, adjacent to the slit 10. The thick-walled portion 13 is formed by locally increasing the wall thickness of the main body 3, as shown in FIG. 10. Outside of the thick-walled portion 13, a portion with a smaller thickness than that of the thick-walled portion 13 is formed.

As shown in FIG. 8 to FIG. 10, the thick-walled portion 13 includes, for example, an inner thick-walled portion 13*a* and an outer thick-walled portion 13*b*.

The inner thick-walled portion 13*a* is, for example, raised on the hollow portion (i) side. The inner thick-walled portion 13*a* is annularly formed around the slit 10. The inner thick-walled portion 13*a* is effective in relaxing the stresses around the slit 10 of the main body 3. The inner thick-walled portion 13*a* rises from the inner surface 4*i* of the reference thick-walled portion 13*c* formed by the reference thickness tc of the main body 3 (in this example, the crown portion 4) toward the hollow portion (i). The thickness boundary between the inner thick-walled portion 13*a* and the reference thick-walled portion 13*c* is a virtual boundary defined by a smooth extension of the inner surface 4*i* of the reference thick-walled portion 13*c* to the slit 10.

Although a thickness ta of the inner thick-walled portion 13*a* is not particularly limited, it is preferably, for example, equal to or more than 0.5 mm, preferably equal to or more than 1.0 mm, more preferably equal to or more than 1.5 mm, in order to fully demonstrate the stress reduction effect in the area around the slit 10. In order to suppress the weight increase of the head 1, the thickness ta of the inner thick-walled portion 13*a* is, for example, equal to or less than 5.0 mm, preferably equal to or less than 4.0 mm, more preferably equal to or less than 3.0 mm.

The outer thick-walled portion 13*b* is, for example, raised on the outer surface of the head. The outer thick-walled portion 13*b* may form the thick-walled portion 13 together with the inner thick-walled portion 13*a* or in place of the inner thick-walled portion 13*a*. The outer thick-walled portion 13*b* rises outwardly from the outer surface 40 of the reference thick-walled portion 13*c* formed by the reference thickness tc of the main body 3 (in this example, the crown portion 4). The thickness boundary between the outer thick-walled portion 13*b* and the reference thick-walled portion 13*c* is a virtual boundary defined by a smooth extension of the outer surface 40 of the reference thick-walled portion 13*c* to the slit 10.

As shown in FIG. 8, in this embodiment, the outer thick-walled portion 13*b* is formed so that it is partially interrupted around the slit 10. Specifically, the outer thick-walled portion 13*b* is not formed around a front portion of the slit 10 including the frontmost end 10*a*. The frontmost end 10*a* of the slit 10 is located near the periphery E of the face portion 2, which is relatively rigid. Thus, the stress increase near the frontmost end 10*a* of the slit 10 can be mitigated without the outer thick-walled portion 13*b* in this area. Moreover, the partial elimination of the arrangement of the outer thick-walled portion 13*b* can help to reduce the weight of the main body 3 (especially, the crown portion 4). It is also clear from FIG. 8 that the outer thick-walled portion 13*b* has its contour edge extending along the contour shape of the slit 10.

As shown in FIG. 10, a thickness tb of the outer thick-walled portion 13*b* is not particularly limited, but in order to fully demonstrate the effect of reducing tensile stress in the toe-heel direction around the slit 10, for example, it may be equal to or more than 0.5 mm, preferably equal to or more than 1.0 mm, more preferably equal to or more than 1.5 mm. If the thickness tb is too thick, the bending rigidity in the longitudinal direction of the head increases, which in turn increases the bending stress in the longitudinal direction of the head. In order to fully demonstrate the effect of reducing the bending stress in the longitudinal direction around the slit and to suppress the weight increase of the head 1, the thickness tb of the outer thick-walled portion 13*b* is, for example, equal to or less than 5.0 mm, preferably equal to or less than 4.0 mm, more preferably equal to or less than 3.0 mm.

A width TW of the inner thick-walled portion 13*a* and the outer thick-walled portion 13*b* (shown in FIG. 9) is not particularly limited, but it is, for example, equal to or more than 1.0 mm, preferably equal to or more than 2.0 mm, more preferably equal to or more than 3.0 mm, in order to fully demonstrate the stress reduction effect in the peripheral area of the slit 10. In order to suppress the increase in weight of the head 1, the width TW of the inner thick-walled portion 13*a* and the outer thick-walled portion 13*b* is, for example, equal to or less than 15.0 mm, preferably equal to or less than 12.0 mm, mor preferably equal to or less than 10.0 mm. The width TW is measured orthogonally to the edge of the slit 10, as illustrated in FIG. 9.

Second Embodiment

Figure 11:
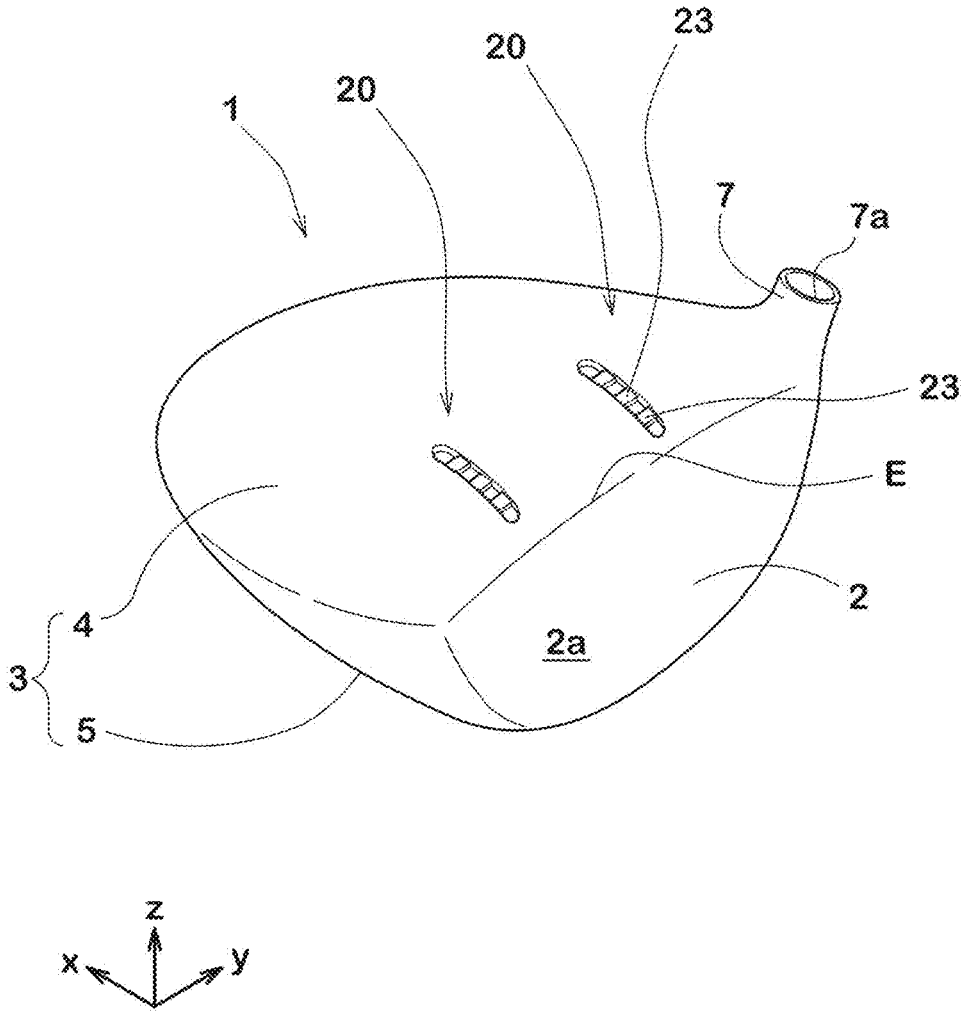
FIG. 11 is a perspective view of the golf club head according to the second embodiment.
Figure 12:
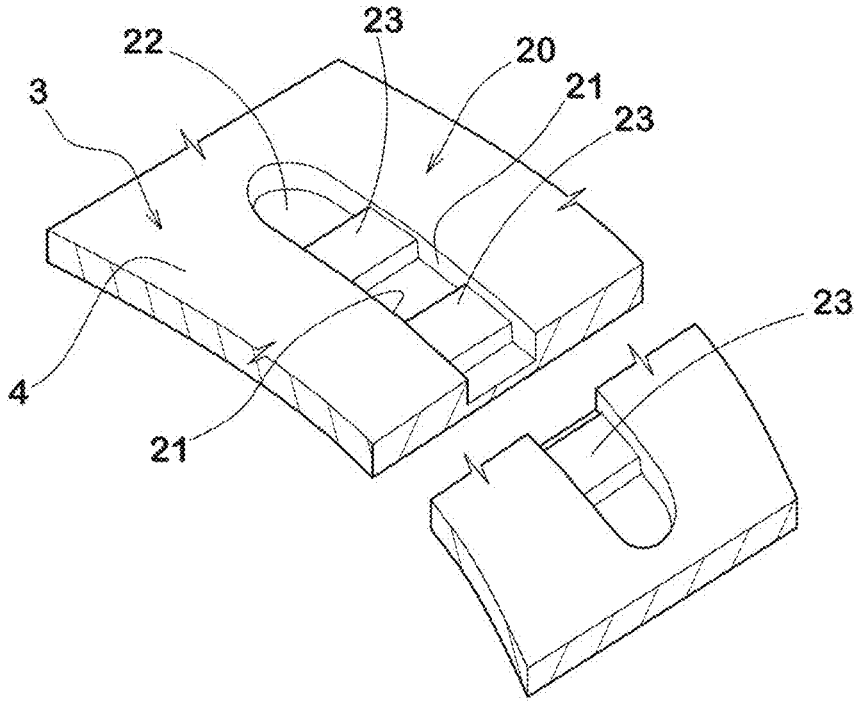
FIG. 12 is a perspective view of a groove.

Referring now to FIGS. 11 and 12, the head 1 according to the second embodiment of the present disclosure will be described. FIG. 11 is a perspective view of the head 1 according to the second embodiment, and FIG. 12 is an enlarged view of the crown portion 4. The head 1 according to the second embodiment differs from the first embodiment in that the main body 3 is provided with at least one groove 20 (in this example, a plurality of grooves 20) extending in the head-front-back direction instead of the slits 10. In FIG. 11, the grooves 20 are provided in the same position as the slits 10 shown in FIGS. 1 to 4.

As shown in FIG. 12, the plurality of grooves 20 each includes a pair of groove walls 21, 21 extending in the head-front-back direction of the head, a groove bottom 22, and at least one joint 23 locally raised from the groove bottom 22 and connecting the pair of groove walls 21 and 21. In this embodiment, each groove 20 has three joints 23 as a plurality.

The grooves 20 can provide the same advantages as the slits 10 of the first embodiment. That is, the grooves 20 can locally reduce the stiffness of the main body 3 (for example, the crown portion 4 and/or the sole portion 5) in the toe-heel direction without substantially changing the bending stiffness in the head-front-back direction. Thus, the main body 3 with the grooves 20 can flex more greatly in the toe-heel direction when the ball is struck, starting from the grooves 20. This expands the highly resilient area of the face portion 2 in the direction of area provided with the grooves 20.

As in the first embodiment, the joints 23 provided in each groove 20 can be used as an adjusting member to adjust the tensile stiffness of the head body 3 in the toe-heel direction of the head. For example, after the head 1 is manufactured, at least one joint 23 of any groove 20 may be at least partially removed, if necessary. The groove 20 from which one or more joints 23 have been removed will reduce the tensile stiffness of the main body 3 in the toe-heel direction more than the other grooves 20 from which the joints 23 have not been removed. Such a groove 20 can provide greater deflection of the main body 3 in the toe-heel directions when striking the ball, and can expand the high repulsion area (increase the CT value) in the direction where the groove 20 is located. Thus, the head 1 according to this example can also adjust the CT value without grinding the face portion 2. In other words, the rebound performance of the head 1 can be adjusted while preventing changes in the trajectory of hit balls.

Figure 13:
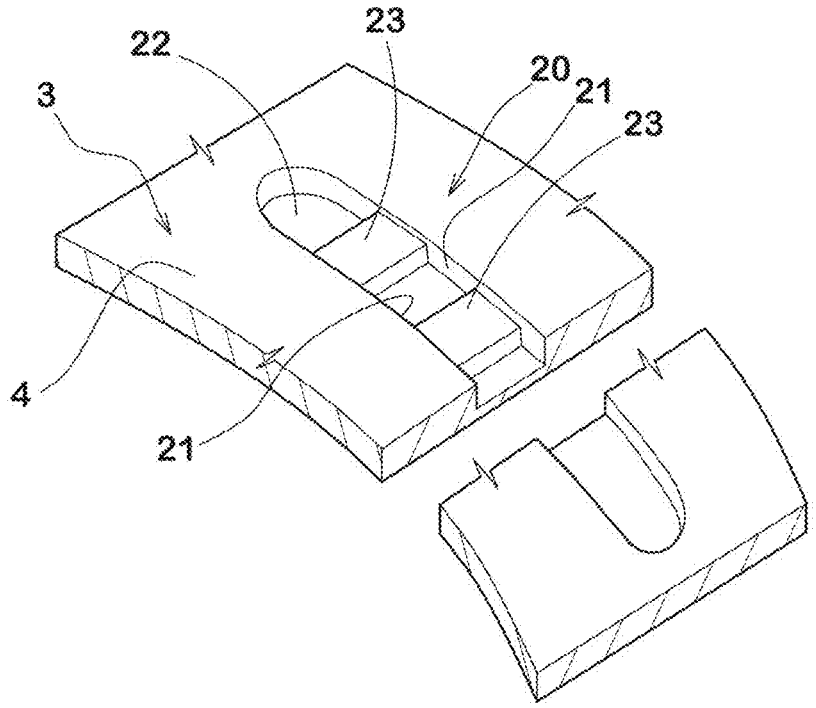
FIG. 13 is a perspective view of the groove with one joint removed.

FIG. 13 is a perspective view showing an example in which one joint 23 is removed from the groove 20 of FIG. 12. In FIG. 13, the frontmost joint 23 has been removed. For example, the joint 23 may be completely removed so as to form a continuous plane with the groove bottom 22. In other cases, the joint 23 may be partially removed. In this case, the partially removed joint 23 may still protrude from the groove bottom 22, although the height of the partially removed joint 23 is reduced from the previous state. Such partial removal of joint 23 may also reduce the tensile stiffness near the groove 20.

When a plurality of joints 23 is provided in one groove 20, one or more joints 23 may be removed. When a plurality of joints 23 is provided in the head-front-back direction, the margin of CT improvement can be adjusted arbitrarily by changing the number of joints 23 to be removed. In addition, the length L, width W, and the location of the slits 10 described in the first embodiment can be applied to the length, width, and the location of the grooves 20 of the second embodiment, respectively.

[Slit and Groove Covers]

In the head 1 according to the first and second embodiments, a cover (not illustrated) made of an elastic material such as rubber, resin, elastomer, etc. may be provided to cover a void of each slit 10 and/or each groove 20. Such a cover can prevent foreign objects from entering the slits 10 and/or grooves 20 without interfering with the deformation of the main body 3 in any way.

[Manufacturing Method of Golf Club Head]

Next, a method for manufacturing a golf club head of the present embodiment will be described. The process procedure of this manufacturing method is shown in FIG. 14.

[First Step]

Figure 14:
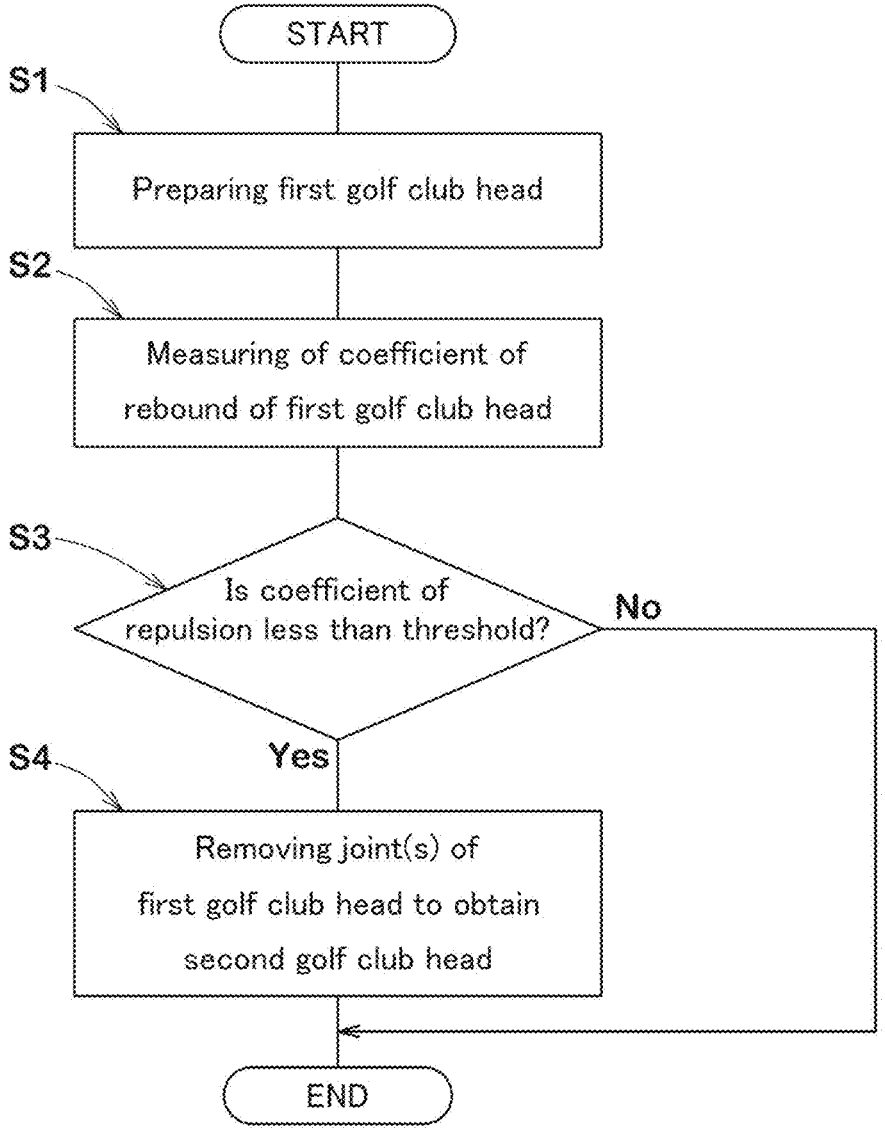
FIG. 14 is a flowchart illustrating a manufacturing method according to an embodiment.

As shown in FIG. 14, the manufacturing method according to this embodiment includes a first step of preparing a first golf club head (step S1). The first golf club head has the same configuration as the head 1 of the first embodiment described in FIGS. 1 to 6, for example. That is, the head 1 includes the face portion 2 and the main body 3 including the crown portion 4 and the sole portion 5 each extending backwardly of the head from the face portion 2. The main body 3 is provided with at least one slit 10 that penetrates the main body 3 and extends in the head-front-back direction. The slit 10 has a pair of slit inner walls 11 extending in the head-front-back direction and at least one joint 12 connecting the pair of the slit inner walls 11 to each other as shown in FIG. 5 and FIG. 6.

[Second Step]

Next, the manufacturing method according to this embodiment includes a second step of measuring a CT value of the first golf club head (step S2).

Preferably, the CT value is measured at a plurality of positions on the striking face 2*a* of the head 1 in FIG. 2 in the toe-heel direction and in the head-up-down direction. For example, the striking face 2*a* is divided into grids with the origin at the face center FC, 25 mm each in the toe-heel direction, and 15 mm each in the head-up-down direction, at 5 mm intervals, and the CT values are measured at some of these grid positions. In most cases, the maximum CT value of golf club heads tends to be at the face center FC. In this example, the CT value is measured at several locations including the face center FC.

[Third Process (1/2)]

Next, the manufacturing method according to this embodiment includes the process of determining whether one or more measured CT values are smaller than a predetermined threshold value (step S3). For example, if a manufacturer of the first golf club head try to improve the maximum CT value of the first golf club head (hereinafter referred to as "CTmax"), the CTmax of the first golf club head is compared with the threshold value. The threshold value, for example, can be determined in various ways based on the upper limit of CT value (239 μs) specified in the Rules of Golf. For example, the threshold value may correspond to the upper limit of the CT. In another case, the threshold value may be set to a value slightly smaller than the upper limit in consideration of measurement errors, etc.

[Third Process (2/2)]

The manufacturing method according to the present embodiment then includes the process of obtaining a second golf club head by at least partially removing at least one of the joints 12 of the first golf club head if the concerned CT value is smaller than the predetermined threshold value (Yes in step S3). Thus, the second golf club head has at least one slit 10 from which one or more joints 12 have been removed, as shown in FIG. 7. The removal may be performed by various methods such as cutting, grinding, etc.

For example, if the CTmax of the first golf club head is smaller than the threshold value, one or more joints 12 at a given position may be removed. The number of joints to be removed is determined according to the difference between the CTmax and the threshold value. For example, it is preferable that the larger the difference is, the more the number of joints 12 to remove. Further, one or more joints 12 closest to the position of the CTmax in the toe-heel direction may be selected to be removed as joints 12 to be removed.

In order to increase the CTmax more effectively, the relationship among the number and position of the joints 12 to be removed, the CT improvement margin, and the position at which the CT values is improved may be determined in advance by experiments or simulations. In some preferred embodiments, the dimensions of the joints 12 may be designed so that the CT improves in a range of 2 to 4 us by removing one of the joints.

If necessary, one or more CT values of the second golf club head in which one or more joints 12 have already been removed may be measured. In this case, if the difference between the CTmax of the second golf club head and the threshold value is larger than a predetermined value, the third step may be repeated.

In the above embodiment, the case of further increasing the CTmax is described, but this manufacturing method can also be used to adjust a distribution of CT values. For example, in many cases, a CT value of golf club heads tends to be low at the striking positions that are shifted from the face center FC to the toe or heel side. Thus, if the CT value at a toe-side striking position is smaller than the predetermined threshold value, removing one or more joints 12 at the toe-side slit 10 can effectively increase the CT value at the toe-side striking position while suppressing an excessive increase in the CTmax. Similarly, if the CT value at a heel-side striking position is smaller than a predetermined threshold value, removing one or more joints 12 at the heel-side slit 10 can effectively increase the CT value at the heel-side striking position while suppressing the excessive increase of the CTmax.

In the above embodiment, the first golf club head is the head 1 according to the first embodiment, but in another embodiment, the first golf club head may be the head 1 according to the second embodiment. That is, the first golf club head may include the face portion 2 and the main body 3 extending backwardly of the head from the face portion 2, wherein the main body 3 is provided with one or more grooves 20, each groove 20 comprising a pair of groove walls 21 extending in the head-front-back direction, a groove bottom 22, and at least one joint 23 locally rising from the groove bottom 22 and connecting the pair of groove walls 21.

While the particularly preferable embodiments in accordance with the present disclosure have been described in detail, the present disclosure is not limited to the illustrated embodiments, but can be modified and carried out in various aspects within the scope of the disclosure.

Example

A wood-type golf club head shown in FIGS. 1 to 4 was prepared. The specification of the head is as follows.

Head material: Titanium alloy
Head volume: 460 cc
Head weight: 172 g
Thickness of the face portion:
3.7 mm at the center region
2.1 mm at the periphery region
The thickness varies smoothly from the center region toward the periphery region.
Length of the slits L: 22 mm
Width of slits W: 2 mm
Number of joints in one slit: 3
Joints: Each joint had a rectangular cross-section having 1.8 mm thickness in the head-up-down direction, and 1.8 mm long in the head-front-back direction of the head.

The slits in the crown portion are arranged 24 mm away from the face center to the toe and heel sides and extend parallel to the head-front-back direction.

The minimum distance D between the crown portion slits and the periphery E of the face portion is 1.0 mm.

The slits in the sole portion extend parallel to the head-front-back direction and are arranged such that one is in the central region and two are in the toe and heel regions away from the face center to the toe and heel by 26 mm.

First, a CT value of the first golf club head with all joints left was measured. The CT values at major hitting positions were shown in FIG. 15A. In each table of FIGS. 15A to 15C, the horizontal axis represents the toe-heel direction, the vertical axis represents the head-up-down direction, and the origin is indicated as the face center, and the unit of each coordinate is the distance from the origin (in millimeters). FIG. 15A shows that the CTmax occurs at the face center, and its value is 234 (unit: μs), which is smaller than the upper limit (threshold value) of the Rules of Golf, i.e., 239 μs.

Next, in the first golf club head, all three joints of the center slit of the sole portion were removed by cutting to obtain the second golf club head. The major CT values of the striking face of the second golf club head were as shown in FIG. 15B. The CTmax of the second golf club head occurred at the face center and its value was 239 μs, which corresponded to the upper limit of the Rules of Golf. In this example, the removal of all three joints of one slit resulted in an increase in the CT value of 5 μs with respect to the face center.

FIG. 15C shows the difference of the CT values of the second golf club head minus the CT values of the first golf club head. It is clear from FIG. 15C that in the second golf club head, there was a significant increase (12 μs) in the CT value at the position 15 mm away from the face center to the sole portion, corresponding to the removed joints.

Figures 16, 17:
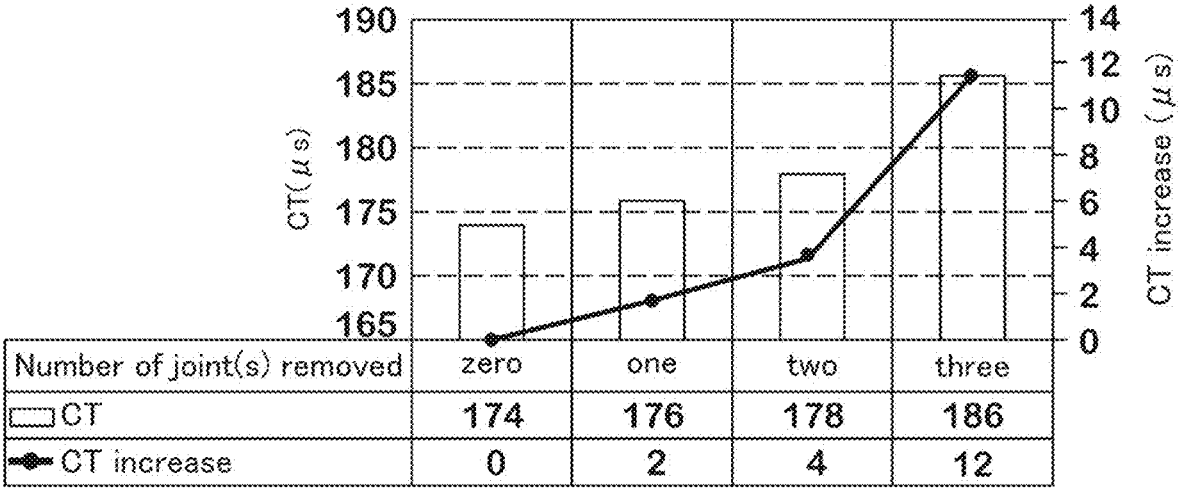
FIG. 16 is a graph showing the difference between the CTs of the second golf club head and the first golf club head in another example.
FIG. 17 is a graph showing the relationship between the number of slits removed and the amount of increase in the CT at the face center.

The following is an example of another manufacturing method. For the first golf club head described above, all three joints of the toe-side slit of the sole portion were removed by cutting to obtain another second golf club head. FIG. 16 shows the difference of the CT values of the second golf club head minus the CT values of the first golf club head. As shown in FIG. 16, in the second golf club head, a significant increase (13 μs) of the CT value was observed at the hitting position on the toe and sole sides, corresponding to the removed joints. The increase of CT at the face center was only 2 μs.

FIG. 17 shows the relationship between the number of slits removed in the center of the sole portion in the toe-heel direction and the increase in the CT value at the face center for the first golf club head. FIG. 17 shows that the CT increases as the number of joints to be removed increases.

Furthermore, Table 1 shows the results of the hitting test using a swinging robot. The first golf club head and the second golf club head were used for the hitting test, and the same golf balls were hit under the same conditions. The backspin and launch angle of each ball were measured.

TABLE 1

| Face center hitting point | | | |
|---|---|---|---|
| | CT (μs) | Backspin (rpm) | Launch angle (deg.) |
| First golf club head | 215 | 2655 | 8.76 |
| Second golf club head | 228 | 2638 | 8.74 |
| Difference | 13 | −17 | −0.02 |

As a result of the test, the second golf club head shows no substantial difference in the trajectory of hit balls compared to the first golf club head, while the CT value of the face center was increased by 13 μs with respect to the first golf club head.

[Additional Notes]

The present disclosure includes the following aspects.

[Note 1]

A golf club head having a hollow portion therein, the head comprising:

a face portion; and a main body comprising a crown portion and a sole portion each extending backwardly from the face portion, wherein the main body is provided with at least one slit that penetrates the main body and extends in a head-front-back direction, and the at least one slit comprises a pair of slit inner walls extending in the head-front-back direction and at least one joint connecting the pair of slit inner walls to each other.

[Note 2]

The golf club head according to note 1, wherein the at least one slit comprises a plurality of slits, and at least one of the crown portion and the sole portion is provided with the plurality of slits that is spaced in a toe-heel direction of the head.

[Note 3]

The golf club head according to note 1 or 2, wherein the at least one joint comprises a plurality of joints.

[Note 4]

The golf club head according to any one of notes 1 to 3, wherein the at least one joint has a cylindrical or prismatic shape extending in a toe-heel direction of the head.

[Note 5]

The golf club head according to any one of notes 1 to 4, wherein the at least one slit comprises a frontmost end and a backmost end in the head-front-back direction, and the at least one joint is spaced apart from the frontmost and backmost ends of the at least one slit in the head-front-back direction of the head.

[Note 6]

The golf club head according to any one of notes 1 to 5, wherein in a plan view of the at least one slit, a total joint projected area is equal to or less than 0.8 times a projected area of the slit including the at least one joint.

[Note 7]

The golf club head according to any one of notes 1 to 6, wherein a thick-walled portion in which a thickness of the main body is locally increased is formed around the at least one slit.

[Note 8]

A golf club head having a hollow portion therein, the head comprising:

a face portion; and a main body comprising a crown portion and a sole portion each extending backwardly from the face portion, wherein the main body is provided with at least one groove that extends in a head-front-back direction, and the at least one groove comprises a pair of groove walls extending in the head-front-back direction, a groove bottom, and at least one joint locally raised from the groove bottom and connecting the pair of groove walls to each other.

[Note 9]

The golf club head according to note 8, wherein the at least one joint comprises a plurality of joints.

[Note 10]

The golf club head according to note 8 or 9, wherein the at least one groove comprises a plurality of grooves, and at least one of the crown portion and the sole portion is provided with the plurality of grooves that is spaced in a toe-heel direction of the head.

[Note 11]

A method for manufacturing a golf club head, the method comprising:

a first step of preparing a first golf club head, wherein the first golf club head comprises a face portion and a main body comprising a crown portion and a sole portion each extending backwardly from the face portion, the main body being provided with at least one slit that penetrates the main body and extends in a head-front-back direction, the at least one slit being provided with a pair of slit inner walls extending in the head-front-back direction and at least one joint connecting the pair of slit inner walls to each other;

a second step of measuring a CT value of the first golf club head; and a third step of at least partially removing the at least one joint of the first golf club head to obtain a second golf club head if the CT value of the first golf club head is less than a predetermined threshold.

[Note 12]

A method for manufacturing a golf club head, the method comprising:

a first step of preparing a first golf club head, wherein the first golf club head comprises a face portion and a main body comprising a crown portion and a sole portion each extending backwardly from the face portion, the main body being provided with at least one groove that extends in a head-front-back direction, the at least one groove comprising a pair of groove walls extending in the head-front-back direction, a groove bottom, and at least one joint locally raised from the groove bottom and connecting the pair of groove walls to each other;

a second step of measuring a CT value of the first golf club head; and a third step of at least partially removing the at least one groove of the first golf club head to obtain a second golf club head if the CT value of the first golf club head is less than a predetermined threshold.

The invention claimed is:

1. A golf club head having a hollow therein, and comprising:

a face portion; and a main body comprising a crown portion and a sole portion each extending backwardly from the face portion, wherein the main body is provided with at least one slit extending in a front-back direction of the head, the at least one slit comprises a pair of slit inner walls extending in the front-back direction and joints connecting the pair of slit inner walls to each other, the joints are arranged in the front-back direction with a space in the front-back direction between adjacent joints, a portion or portions between the joints, a front end portion, and a rear end portion of the slit are formed as through holes penetrating a portion of the main body where the slit is formed, a thick-walled portion in which a wall thickness of the main body is locally increased is formed around the at least one slit, and a thickness of each of the joints is less than a wall thickness if a portion of ding the slit, an outer surface of each of the joints is recessed from an outer surface of the main body in a stepped manner, and an inner surface of each of the joints is flush with an inner surface of the main body, and in a plan view of the at least one slit, a total projected area of the joints is equal to or less than 0.8 times a projected area of the slit including the joints.

2. The golf club head according to claim 1, wherein the at least one slit comprises a plurality of slits, and one of or each of the crown portion and the sole portion is provided with the plurality of slits, and the slits are spaced in a toe-heel direction of the head.

3. The golf club head according to claim 2, wherein a number of the plurality of the slits is two or three.

4. The golf club head according to claim 1, wherein each of the joints has a cylindrical or prismatic shape extending in a toe-heel direction of the head.

5. A golf club head having a hollow therein, and comprising:

a face portion; and a main body comprising a crown portion and a sole portion each extending backwardly from the face portion, wherein the main body is provided with at least one slit extending in a front-back direction of the head, the at least one slit comprises a pair of slit inner walls extending in the front-back direction and joints connecting the pair of slit inner walls to each other, the joints are arranged in the front-back direction with a space in the front-back direction between adjacent joints, a portion or portions between the joints, a front end portion, and a rear end portion of the slit are formed as through holes penetrating a portion of the main body where the slit is formed, a thickness or each of the joints is less than a wall thickness of a portion of the main body surrounding the slit, an outer surface of each of the joints is recessed from an outer surface of the main body in a stepped manner, and an inner surface of each of the joints is flush with an inner surface of the main body, and in a plan view of the at least one slit, a total projected area of the joints is equal to or less than 0.8 times a projected area of the slit including the joints.

6. The golf club head according to claim 5, wherein the at least one slit comprises a plurality of slits, and one of or each of the crown portion and the sole portion is provided with the plurality of slits, and the slits are spaced in a toe-heel direction of the head.

7. The golf club head according to claim 6, wherein a number of the plurality of the slits is two or three.

8. The golf club head according to claim 5, wherein each of the joints has a cylindrical or prismatic shape over its length in a toe-heel direction of the head.

9. A golf club head having a hollow therein, and comprising:

a face portion; and a main body comprising a crown portion and a sole portion each extending backwardly from the face portion, wherein the main body is provided with at least one groove extending in a front-back direction of the head, the at least one groove comprises a pair of groove walls extending in the front-back direction, a groove bottom, and joints locally raised from the groove bottom and connecting the pair of groove walls to each other, the joints are arranged in the front-back direction with a space in the front-back direction between adjacent joints, an outer surface of each of the joints is recessed from an outer surface of the main body in a stepped manner, a portion or portions between the joints, a front end portion, and a rear end portion of the groove are formed as recessed portions with bottoms further recessed from the outer surfaces of the joints, a thick-walled portion in which a wall thickness of the main body is locally increased is formed around the at least one groove, and in a plan view of the at least one groove, a total projected area of the joints is equal to or less than 0.8 times a projected area of the groove including the joints.

10. The golf club head according to claim 9, wherein the at least one groove comprises a plurality of grooves, and one of or each of the crown portion and the sole portion is provided with the plurality of grooves, and the grooves are spaced in a toe-heel direction of the head.

11. The golf club head according to claim 9, wherein each of the joints has a cylindrical or prismatic shape extending in a toe-heel direction of the head.

12. The golf club head according to claim 11, wherein a number of the plurality of the slits is two or three.

13. A golf club head having a hollow therein, and comprising:

a face portion; and a main body comprising a crown portion and a sole portion each extending backwardly from the face portion, wherein the main body is provided with at least one groove extending in a front-back direction of the head, the at least one groove comprises a pair of groove walls extending in the front-back direction, a groove bottom, and joints locally raised from the groove bottom and connecting the pair of groove walls to each other, the joints are arranged in the front-back direction with a space in the front-back direction between adjacent joints, an outer surface of each of the joints is recessed from an outer surface of the main body in a stepped manner, a portion of portions between the joints, a front end portion, and a rear end portion of the groove are formed as recessed portions with bottoms further recessed from the outer surfaces of the joints, and in a plan view of the at least one groove, a total projected area of the joints is equal to or less than 0.8 times a projected area of the groove including the joints.

14. The golf club head according to claim 13, wherein the at least one groove comprises a plurality of grooves, and one of or each of the crown portion and the sole portion is provided with the plurality of grooves, and the grooves are spaced in a toe-heel direction of the head.

15. The golf club head according to claim 14, wherein a number of the plurality of the slits is two or three.

16. The golf club head according to claim 13, wherein each of the joints has a cylindrical or prismatic shape over its length in a toe-heel direction of the head.

* * * * *